US005557373A

United States Patent [19]

Miyashita et al.

[11] Patent Number: 5,557,373

[45] Date of Patent: Sep. 17, 1996

[54] CLEANING SYSTEM FOR CHARGING DRUM OF AN IMAGE FORMING APPARATUS

[75] Inventors: Yoshiaki Miyashita, Kawasaki; Takeshi Tabuchi, Kawaguchi; Kouichi Yamazaki, Yokohama; Nobuo Kikuchi, Kawagoe; Kentaro Matsumoto, Ichikawa; Sadao Takahashi; Tadashi Hayakawa, both of Tokyo, all of Japan

[73] Assignee: Ricoh Company, Ltd., Tokyo, Japan

[21] Appl. No.: 336,208

[22] Filed: Nov. 4, 1994

[30] Foreign Application Priority Data

Nov. 5, 1993 [JP] Japan ..... 5-277017

[51] Int. Cl.[6] ..... G03G 15/02; G03G 21/00

[52] U.S. Cl. ..... 355/219

[58] Field of Search ..... 355/200, 219, 355/296

[56] References Cited

U.S. PATENT DOCUMENTS

| | | | |
|---|---|---|---|
| 4,924,268 | 5/1990 | Ogura | 355/219 |
| 5,053,827 | 10/1991 | Tompkins et al. | 355/296 X |
| 5,196,893 | 3/1993 | Nishise et al. | 355/296 X |
| 5,239,350 | 8/1993 | Godlove | 355/296 X |
| 5,436,701 | 7/1995 | Shimojo et al. | 355/219 |

*Primary Examiner*—Fred L. Braun

*Attorney, Agent, or Firm*—Oblon, Spivak, McClelland, Maier & Neustadt, P.C.

[57] ABSTRACT

In an image forming apparatus having a charging member for charging a photoconductive element in the form of a drum or a belt in contact therewith, a cleaning member cleans the surface of a charge roller contacting the photoconductive element. The cleaning member is usually spaced apart from the surface of the charge roller, but the former is caused to contact the latter only for a predetermined period of time at predetermined intervals. This frees the charge roller from excessive cleaning due to the cleaning member and, therefore, obviates defective images. The time for causing the cleaning member to contact the charge roller may be changed on the basis of the degree of contamination of the charge roller in order to cope with accidental smears brought about on the charge roller.

3 Claims, 9 Drawing Sheets

CLEANING SYSTEM FOR CHARGING DRUM OF AN IMAGE FORMING APPARATUS

BACKGROUND OF THE INVENTION

1. Field of the Invention

The present invention relates to an electrophotographic copier, optical printer, facsimile apparatus or similar image forming apparatus of the type having a charging member for charging a photoconductive element implemented as a drum or a belt in contact therewith.

2. Discussion of Background

An image forming apparatus of the type described has a charger for charging a photoconductive element. A corona charger, which is specific form of the charger, is extensively used since it can charge the surface of the photoconductive element uniformly. A corona charger, however, produces harmful ozone and nitrogen oxides as a result of corona discharge. Further, such ozone and nitrogen oxides are apt to deposit on the photoconductive element, charger, optics and other constituents of the apparatus, degrading image quality available with the apparatus.

In light of the above, there has been proposed a charging device having a charging member capable of charging the photoconductive element in contact therewith by being applied with a voltage, as taught in, for example, Japanese Patent Laid-Open Publication No. 63-149668. Even such a contact type charging device has some issues yet to be solved, as follows. For example, the device successfully lowers the voltage necessary for the surface of the photoconductive element to be charged to a desired potential and, therefore, enhances efficient charging. However, despite that a cleaning unit cleans the surface of the photoconductive element after the transfer of a toner image from the element to a paper, some toner is still left on the element and transferred to the surface of a charge roller, or charging member, in stripes. The toner so deposited on the charge roller invites defective charging which would result in an irregular charge distribution and defective including blurred images and images with white stripes or black stripes.

To eliminate the above problem, a cleaning m ember implemented by felt may be constantly held in contact with the charge roller in order to clean the surface of the roller, as disclosed in, for example, Japanese Patent Laid-Open Publication No. 2-272582. Alternatively, the cleaning member may be implemented by foam polyurethane, foam polyethylene or similar sponge, as proposed in, for example, Japanese Patent Laid-Open Publication No. 3-101768. Also proposed in the past is a cleaning member movable into and out of contact with the charge roller. A problem with such conventional configurations is that both the cleaning member and the charging member suffer from a lack of durability. Another problem is that when the cleaning member is deteriorated, toner deposits on the charging member is irregular amounts and, therefore, appears in stripes or irregularities in an image.

SUMMARY OF THE INVENTION

It is, therefore, an object of the present invention to provide an image forming apparatus capable of effecting extremely stable and uniform charging over a long term, thereby obviating defective images.

An image forming apparatus of the present invention comprises a rotatable photoconductive element, a charging member for charging the photoconductive element in contact therewith while rotating, a cleaning member for cleaning the surface of the charging member contacting the photoconductive element, and a cleaning member moving mechanism for usually holding the cleaning member is a position spaced apart from the surface of the charging member and for causing the cleaning member to contact the surface of the charging member only for a predetermined period of time at a predetermined interval.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
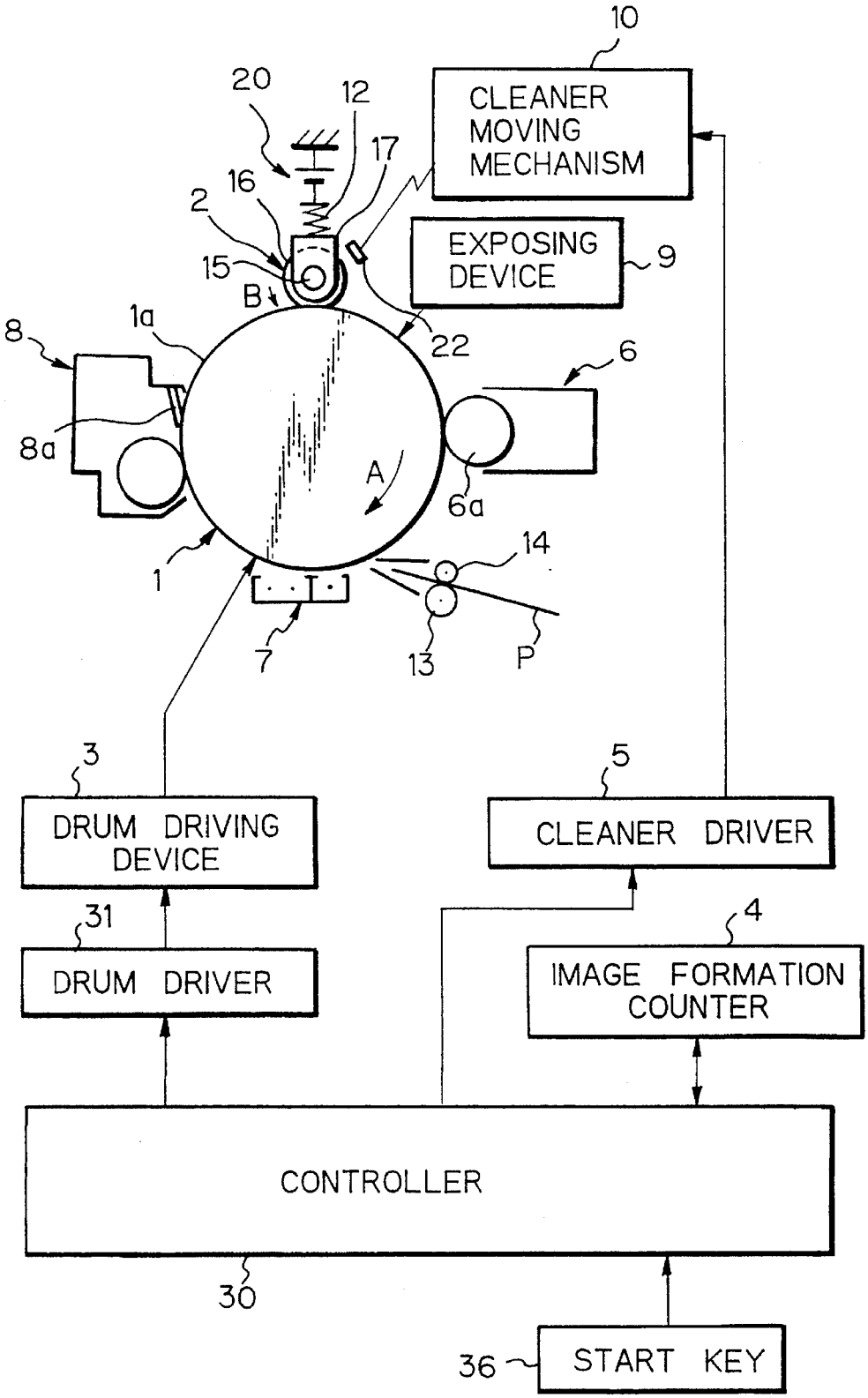
FIG. 1 is a view, including a schematic block diagram, showing an image forming apparatus embodying the present invention.

Referring to FIG. 1 of the drawings, an image forming apparatus embodying the present invention is shown and includes a photoconductive element, or image carrier, in the form of a drum 1. As shown, a charge roller, or charging member, 2 charges the drum 1 in contact therewith. Specifically, while the drum 2 is rotated at a predetermined peripheral speed in a direction indicated by an arrow A, the charge roller 2 is rotated by the drum 2 at the same speed in a direction indicted by an arrow B. In this condition, the charge roller 2 uniformly charges the surface 1*a* of the drum 1 to a predetermined polarity. The drum 1 is driven by a drive mechanism 3 including a timing belt, pulleys, and motor for driving them, although not shown in the figure. The charge roller 2 is constantly pressed against the drum surface 1*a* by a conductive spring 12, which will be described, under a pressure of, for example, 10 g/cm (substantially in line-to-line contact).

A developing device 6, an image transfer and paper separation device 7 and a cleaning unit 8, as well as the charge roller 2, are arranged around the drum 1. Light issuing from an exposing device 9 is incident to the charged surface 1*a* of the drum 1 to form an electrostatic latent image thereon. A developing sleeve 6*a* included in the developing device 6 deposits toner on the latent image to develop it, thereby forming a corresponding toner image.

Papers P are stacked on a cassette, not shown, and fed one by one by a pick-up roller, not shown, which rotates at a predetermined timing. The paper P is once brought to a stop by a registration roller 13 and a pressure roller 14 rotatable in contact with the roller 13. Subsequently, the paper P is driven toward an image transfer position where the image transfer and paper separation device 7 is located, such that it meets the toner image on the drum 1 accurately. After the toner image has been transferred to the upper surface of the paper P, as viewed in FIG. 1, the paper P is separated from the drum 1 and conveyed to a fixing device, not shown. After the toner image has been fixed on the paper by the fixing device, the paper P is driven out of the apparatus to a discharge tray.

After the image transfer, the toner and impurities, including paper dust, remaining on the drum 1 are removed by a cleaning blade 8*a* included in the cleaning unit 8. Further, the potential pattern also left on the drum 1 is erased by a discharge lamp, not shown. The drum 1 is now ready to be charged by the charge roller 2 again.

The charge roller 2 is made tip of a core 15 made of iron or similar conductive metal, and a roller 16 covering the core 15 and made of EPDM (ternary copolymer of ethylene propylene diene) or similar conductive rubber. The core 15 is rotatably supported by conductive bearings 17 at opposite ends thereof. The bearings 17 are constantly biased by respective conductive springs 12 toward the drum 1, so that the charge roller 2 is pressed against the drum surface 1*a* with the axis thereof extending parallel to that of the drum 1. A DC power source applies a bias voltage of, for example, −500 V to the core 15 of the charge roller 2 via the spring 12 and bearing 17. As a result, the charge roller 2 charges the drum surface uniformly, as stated earlier.

A cleaning member 22 adjoins the charge roller 2 in order to clean the surface of the roller 2. The cleaning member, or cleaner as referred to hereinafter, 22 i s selectively brought into or out of contact with the charge roller 2 at a suitable timing by a cleaner moving mechanism 10 which will be described later.

A controller 30 is implemented by a microcomputer and controls various operations of the image forming apparatus. The controller 30 includes a CPU (Central Processing Unit) executing various kinds of decisions and processing, a ROM (Read Only Memory) or program memory storing various kinds of programs necessary for timed operations and fixed data, a RAM (Random Access Memory) available for storing input data and data processed by the CPU, and an I/O (Input/Output) circuit, although not shown in tile figure. When a start key 36 provided on the operation panel, not shown, of the apparatus is pressed to start an image forming operation, a start signal is sent from the start key 36 to the controller 30. A group of keys are also arranged on the operation panel for allowing the operator to select a particular paper size and particular image size and other image forming conditions. The outputs of these keys are also fed to the controller 30.

The controller 30 sends a signal for rotating the drum 1 to a drum driving device 3 via a drum driver 31 at a predetermined timing. Every time image formation, or image forming cycle, completes, tile controller 30 sends a signal to an image formation counter 4 which counts the number of times of image formation, i.e., image forming cycles performed.

Usually, the controller 30 maintains the cleaner 22 spaced apart from the surface of the charge roller 2. Every time the count output from the image formation counter 4 coincides with a predetermined value, e.g., "1,000" or "3,000" stored in the ROM (integral multiple of the predetermined value), the controller 30 sends a signal to a cleaner driver 5. In response, the cleaner driver 5 causes the cleaner moving mechanism 10 to bring the cleaner 22 into contact with the surface 1*a* of the drum 1 and holds it in such a position only for a predetermined period of time, e.g., 60 seconds. The above-mentioned predetermined value, i.e., the interval between the consecutive contacts of the cleaner 22 with the charge roller 2 may be suitably determined depending on, for example, the type of the apparatus.

In the illustrative embodiment, the cleaner moving mechanism 10, cleaner driver 5 for driving it, and the controller 30 constitute, in combination, cleaning member moving means for causing the cleaner 22 to contact the charge roller 2 only for a predetermined period of time at every predetermined interval (every time image formation is repeated a predetermined number of time).

Further, the cleaner driver 5 and controller 30 play the role of means for allowing, after the image formation counter 4 has reached a predetermined value, the above-mentioned cleaning member moving means to hold the cleaner 22 in contact with the charge roller 2 only for a predetermined period of time at a predetermined interval every time the counter 4 reaches any suitable count, as will be described specifically later.

Figure 2:
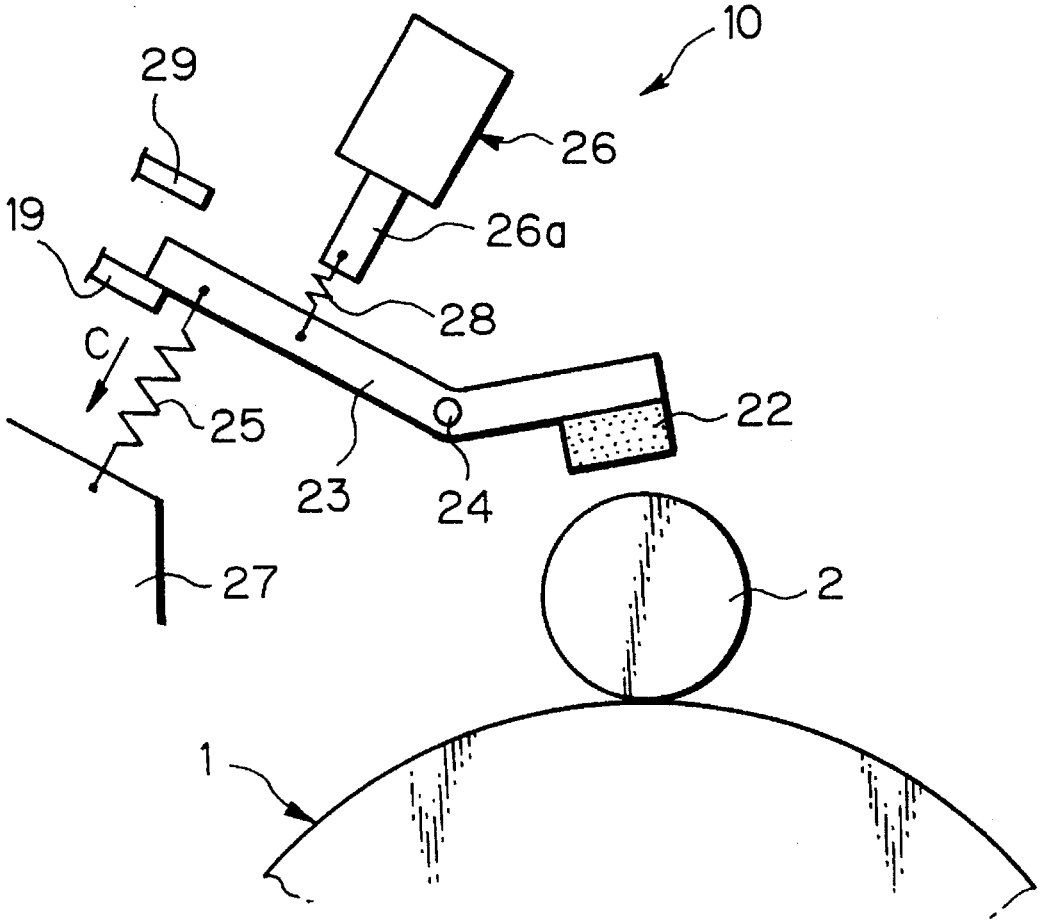
FIG. 2 shows the embodiment in a specific condition wherein a cleaner is spaced apart from a charge roller by a cleaner moving mechanism.
Figure 3:
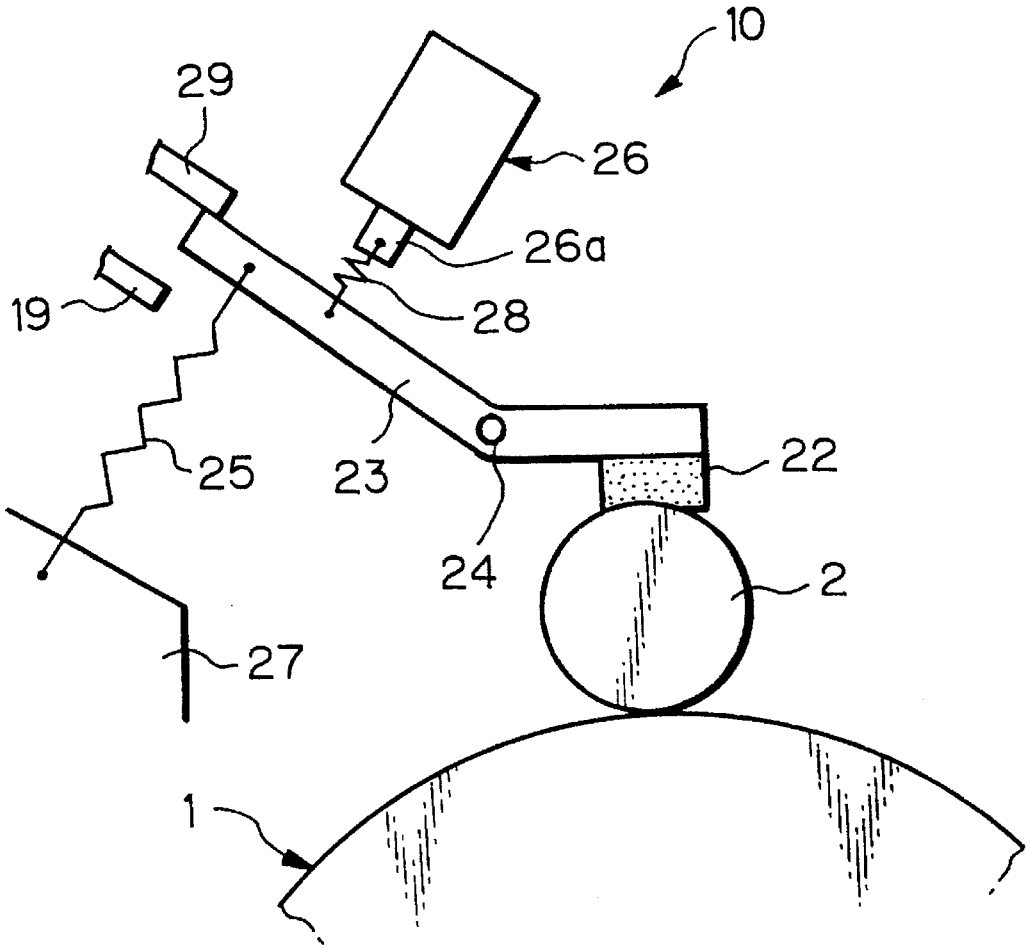
FIG. 3 shows the embodiment in another specific condition wherein the cleaner is held in contact with the charge roller by the same mechanism.

FIGS. 2 and 3 show a specific construction of the cleaner moving mechanism 10. As shown, an arm 23 is rotatably supported by stationary part of the apparatus via a shaft 24 at substantially the intermediate point thereof. The cleaner 22 is affixed to the underside of one end of the arm 23. The cleaner 22 may be implemented by felt, brush or blade by way of example (felt in the embodiment) and may be made of extremely thin fibers, soft foam urethane or Teflon fibers.

A spring 25 is anchored at one end to a frame 27 and at the other end to the left portion, as viewed in FIG. 2, of the arm 23 with respect to the shaft 24. The spring 25 constantly biases the left portion of the arm 23 in a direction indicated by an arrow C in the figure. A spring 28 is anchored at one end to a plunger 26*a* extending from a solenoid 26 and at the other end to the left portion of the arm 23. The springs 25 and 28 counteract each other. As shown in FIG. 2, when the solenoid 26 is deenergized, the arm is rotated counterclockwise, as viewed in the figure, due to the action of the spring 25 until the left end thereof abuts against a stop 19. As a result, the cleaner 22 is spaced apart from the surface of the charge roller 2. As shown in FIG. 3, when the solenoid 26 is energized, it rotates the arm 23 counterclockwise, as viewed in the figure, against the action of the spring 25. The arm 23 is brought to a stop when the left end thereof abuts against a stop 29. In this condition, the cleaner 22 is pressed against the surface of the charge roller 2 under a pressure suitable for cleaning.

Figure 4:
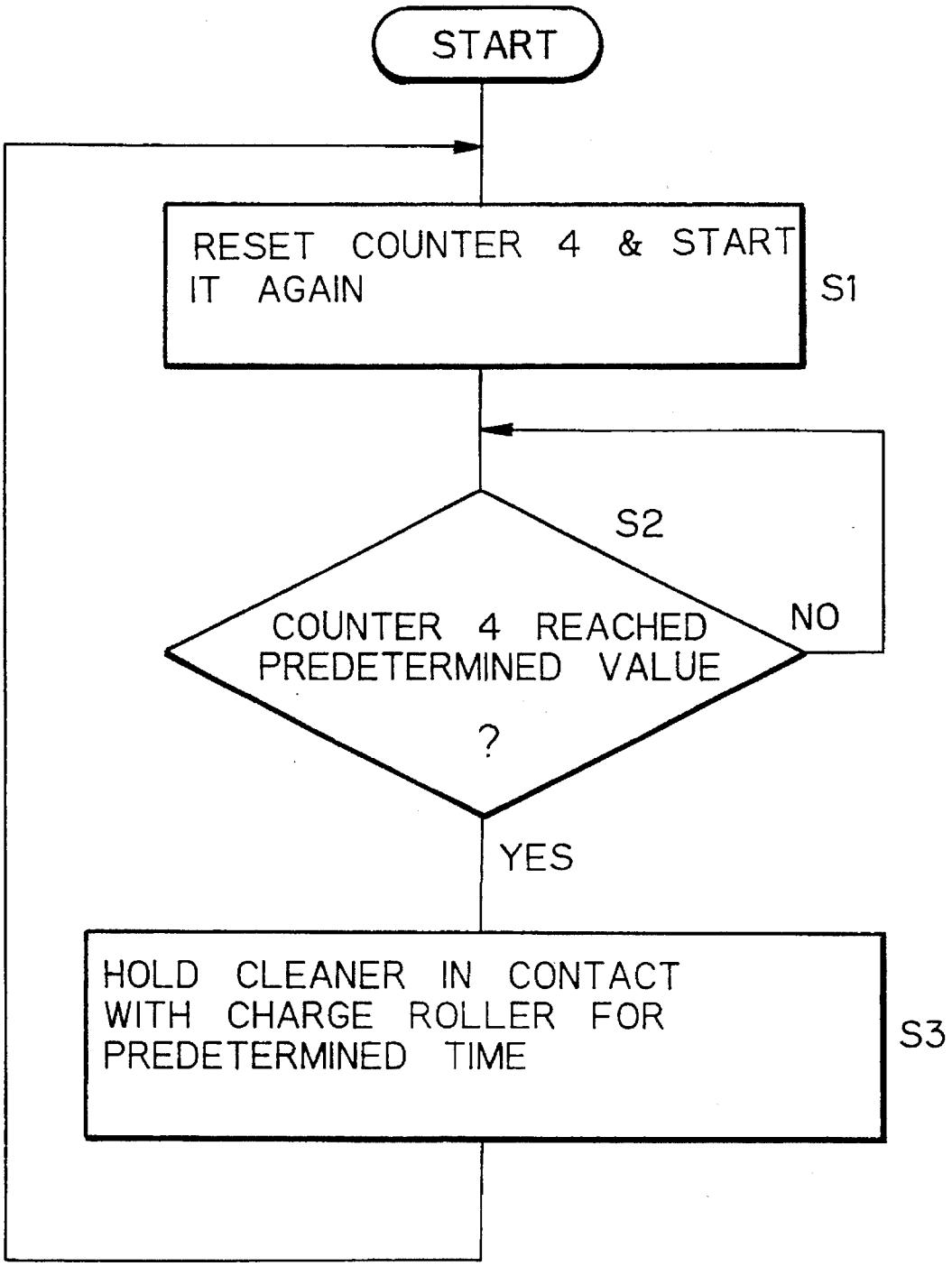
FIG. 4 is a flowchart demonstrating a specific operation of the embodiment.

FIG. 4 shows a routine in which the controller 30, FIG. 1, causes the cleaner 22 to contact the charger roller 2 every time image formation is repeated a predetermined number of times. As shown, the controller 30 resets the counter 4, starts it again, and then increments it every time an image forming cycle completes (step S1). The controller 30 determines whether or not the output count of the counter 4 has reached a predetermined value, e.g., "1,000" or "3,000" (step S2). If the answer of the step S2 is negative, NO, the controller 30 simply waits. As soon as the answer of the step S2 turns to YES, the controller 30 energizes the solenoid 26 of the cleaner moving mechanism 10. As a result, the cleaner 22 is brought into and held in contact with the charge roller 2 only for a predetermined period of time, e.g., 60 seconds. Subsequently, the controller 30 deenergizes the solenoid 26 for thereby moving the cleaner 2 away from the charge roller 2, as shown in FIG. 2. Such a procedure is repeated thereafter.

Now, the toner to deposit on a charge roller is mainly the toner deposited on the surface of a photoconductive element and failed to be removed by a cleaning blade. However, the toner to deposit on the charger roller during a single image forming cycle is extremely small, i.e., the toner covers the charge roller only after the image forming cycle has been repeated thousands of times. Therefore, it is not necessary to maintain a cleaning member in contact with the charge roller at all times. When the cleaning member is held in contact with the charge roller at all times, it is necessary that the cleaning ability thereof be low enough to protect the charge roller from scratches.

Originally, a cleaning member is not expected to remove the entire toner from the surface of the charge roller. The role assigned to a cleaning member is to regulate the toner deposited on the charge roller to a constant amount, or thickness, so as to level it on the charge roller. Assume that the cleaning member is brought into contact with the charge roller when the amount of toner on the roller is smaller than a predetermined amount. Then, the toner on the roller is apt to become irregular and form stripes. Conversely, when the amount of toner on the charge roller is excessive, it is noticeably irregularly distributed on the roller, resulting in irregular charging. Moreover, when hardly any toner exists on the charge roller, the cleaning member brought into contact with the roller is apt to scratch the roller due to frictional resistance, resulting in defective images.

In the illustrative embodiment, the cleaning member, or cleaner, 22 is usually spaced apart from the charge roller 2 and is caused to contact the roller 2 only for a predetermined period of time every time the image forming cycle is repeated a predetermined number of times. Should the cleaner 22 be constantly held in contact with the charger roller 2, it would scratch the surface layer of the charger roller 2 and lead to defective images.

Table 1 shown below lists experimental results comparing a case wherein the cleaner 22 was caused to contact the charge roller 2 for 60 seconds every time 3,000 copies were produced, and a case wherein the former was constantly held in contact with the latter from the beginning. In both cases, an image was formed on a test paper when the image forming cycle was repeated the same number of times so as to see if defects in the form of vertical stripes appeared in the image. For the experiments, use was made of orange test papers (orange chart documents) to find defective images with greater accuracy.

TABLE 1

| Copies (in 1,000) | 2 | 4 | 6 | 8 | 10 | 12 | 14 | 16 |
|---|---|---|---|---|---|---|---|---|
| Contact for 60 Sec Every 3,000 Copies | ○ | ○ | ○ | ○ | ○ | ○ | ○ | ○ |
| Constant Contact from Beginning | ○ | ○ | Δ | Δ | Δ | Δ | X | X |

In Table 1, circles, triangles and crosses respectively represent "no vertical stripes", "two or less vertical stripes" and "three or more vertical stripes".

As Table 1 indicates, when the cleaner 22 is caused to contact the charge roller 22 for 60 seconds every time 3,000 copies are produced, no vertical stripes, or defects, appear up to 16,000th copy. In contrast, when the cleaner 22 is constantly held in contact with the charger roller 2, vertical stripes appear in the 6,000th copy. This also proves that the cleaner 22 should not be constantly held in contact with the charge roller 2, but it should be brought into contact with the charge roller only for a predetermined period of time at predetermined intervals.

The toner left on the drum 1 after image transfer is expected to be removed by the cleaning blade 8*a* of the cleaning unit 8, as described with reference to FIG. 1. However, when paper dust or similar impurity is brought to between the cleaning blade 8*a* and the drum 1 by accident, it often invites defective cleaning. As a result, a great amount of toner is conveyed from between the cleaning blade 8*a* and the drum 1 to the surface of the charge roller 2. Such toner is apt to smear the charge roller 2 before the predetermined number copies have been produced, resulting in defective images. In alternative embodiments to be described with reference to FIGS. 5–9, the cleaner 22 is brought into contact with the charge roller 2 at a timing matching the degree of contamination of the charge roller 2, thereby eliminating defective images.

Figure 5:
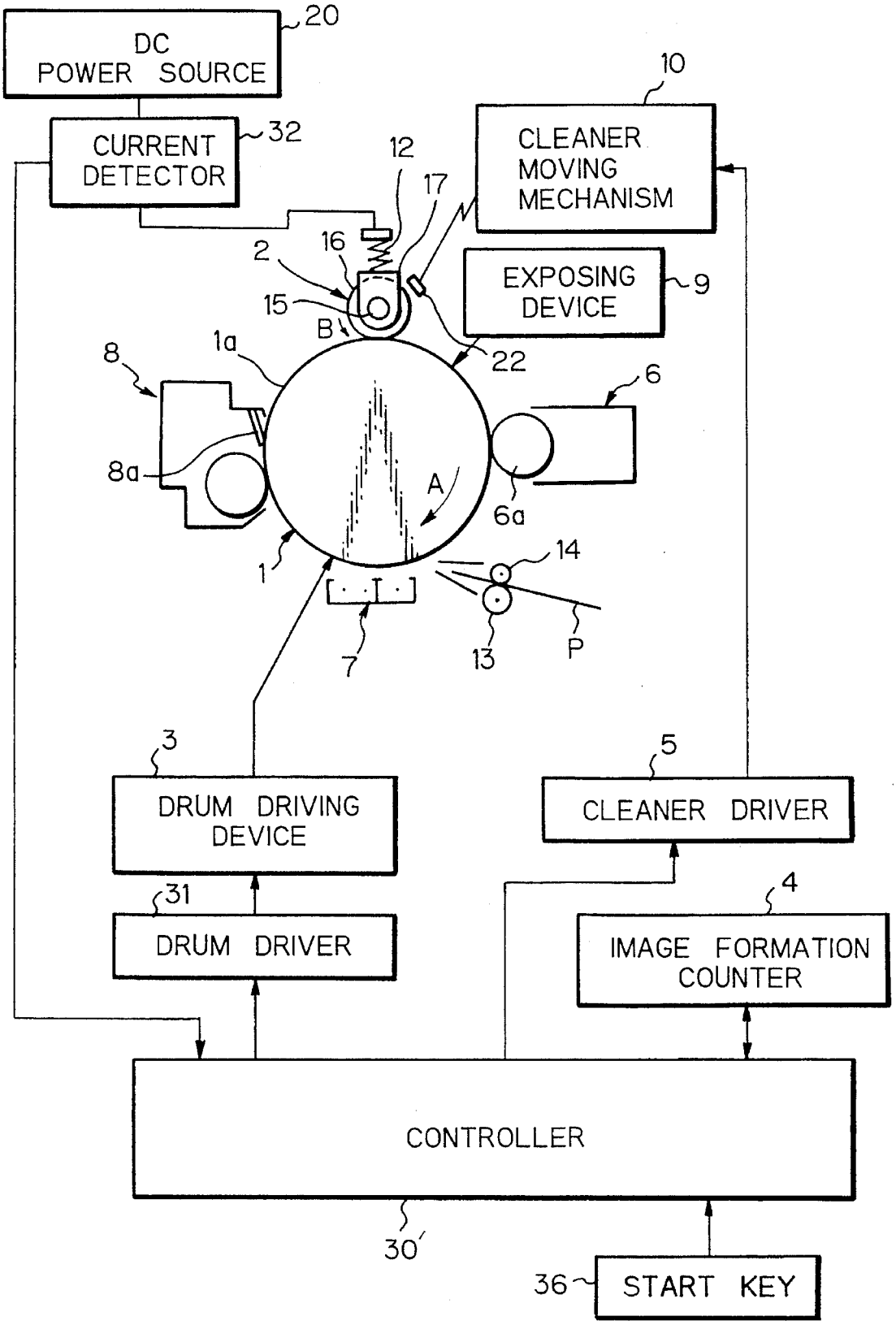
FIG. 5 is a view similar to FIG. 1, showing an alternative embodiment of the present invention.
Figure 6:
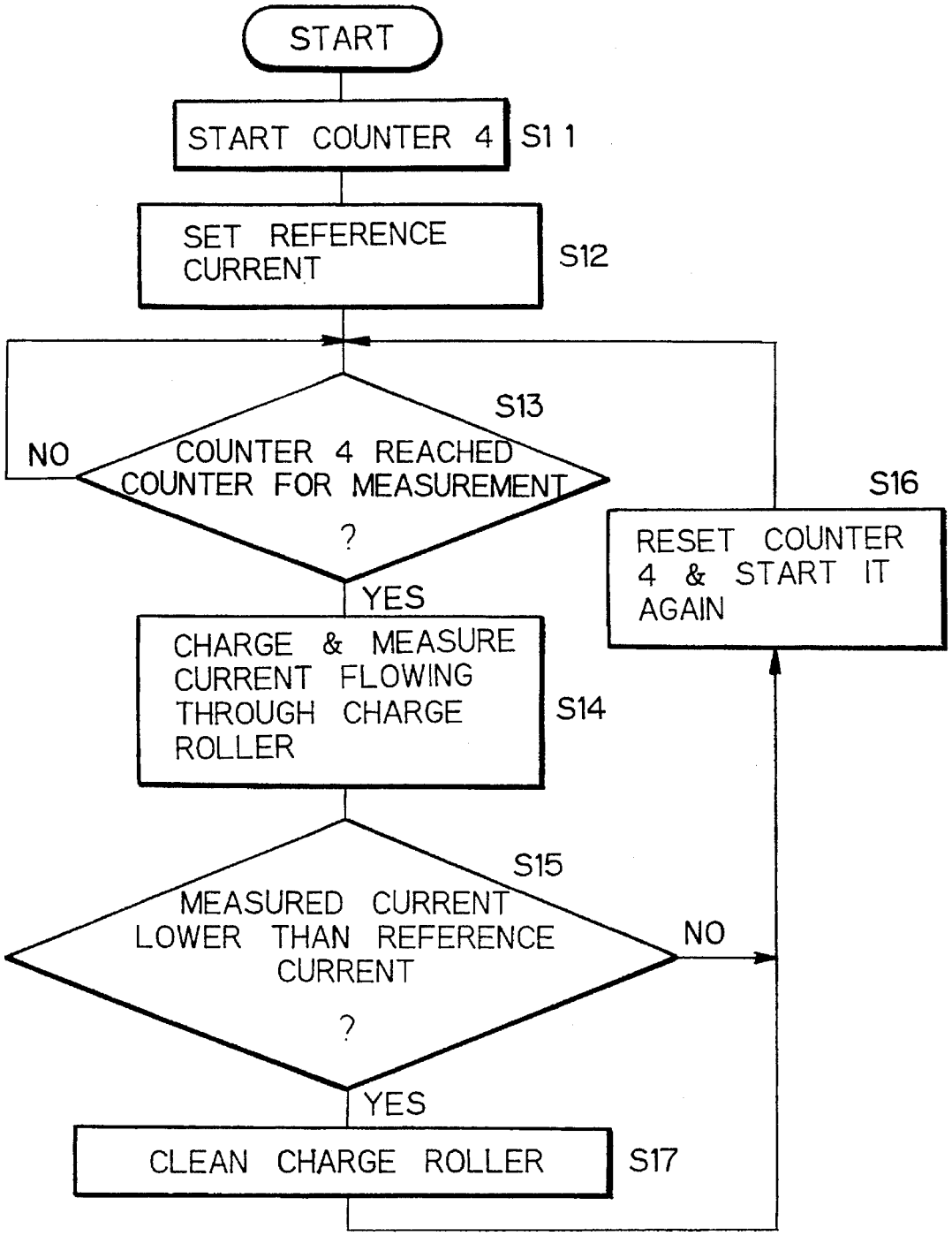
FIG. 6 is a flowchart representing a specific operation of the embodiment shown in FIG. 5.

FIG. 5 shows an alternative embodiment which determines the degree of contamination of the charge roller 2 in terms of a change in the current to flow through the charge roller and changes the predetermined interval at which the cleaner 22 should contact the charge roller 2 accordingly. FIG. 6 is a flowchart demonstrating the operation of this embodiment. As shown in FIG. 5, the embodiment is similar to the previous embodiment except that it additionally has a current detection circuit, or current detector, 32 and that a controller 30' (also implemented by a microcomputer) causes the cleaner 22 to contact the charge roller 2 on the basis of the degree of contamination of the roller 2.

As shown in FIG. 6, the controller 30' starts the image formation counter 4 (step S11) and increments it every time an image forming cycle completes. Then, the controller 30' causes a charging operation for the first measurement to occur. At this instant, the controller 30' receives a current flowing through the charge roller 2 from the current detector 32 and stores it as a reference value (step S12). Alternatively, the reference value, e.g., 50 μA may be stored in a ROM beforehand. Subsequently, the controller 30' determines whether or not the counter 4 has reached a count representing a time for measuring a current to flow through the charge roller 2 (step S13). If the answer of the step S13 is NO, the controller 30' simply waits. As soon as the counter 4 reaches such a count (YES, step S13), the controller 30' causes a charging operation for the second measurement to occur (step S14) in the same manner as in the step S12. Again, the controller 30' receives a current flowing through the charge roller 2 from the current detector 32. Then, the controller 30' determines whether or not the current detected by the second measurement is lower than the reference value set in the step S12 (step S15). If the answer of the step S15 is NO, meaning that the charge roller 2 is scarcely smeared by the toner, the controller 30' resets the counter 4 and starts it again (step S16). Then, the program returns to the step S13.

If the current is lower than the reference value (YES, step S15), meaning that the charge roller 2 has been smeared, the controller 30' drives the cleaner moving mechanism 10 to bring the cleaner 22 into contact with the charge roller 2 (step S17). As a result, the cleaner 22 cleans the surface of the charge roller 2 only for a predetermined period of time, e.g., 60 seconds. Thereafter, the controller 30' resets the counter 4 and starts it again (step S16). Then, the program returns to the step S13 to repeat the decisions and processing described above.

Figure 7:
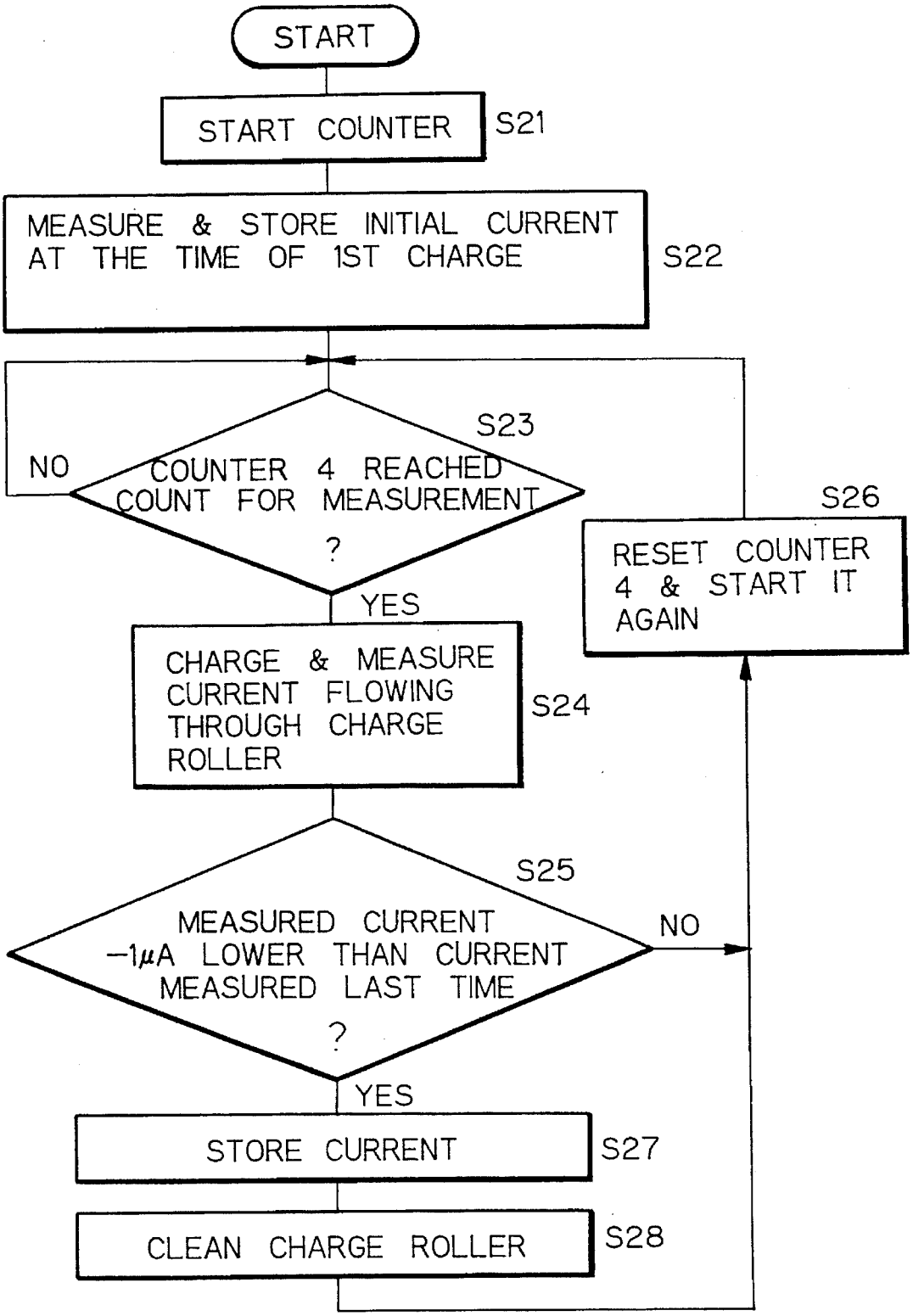
FIG. 7 is a flowchart representing another alternative embodiment of the present invention.

FIG. 7 is a flowchart representing another alternative embodiment of the present invention which determines the time for cleaning the charge roller 2 by a different method. This embodiment is similar to the embodiment of FIG. 6 except for a step S22 and a step S25 and successive steps. As shown, the controller 30' starts the image formation counter 4 (step S21) and then causes a charging operation for the first measurement to occur (step S22). At this instant, the controller 30' receives a current flowing through the charge roller 2 from the current detector 32 and stores it. Subsequently, the controller 30' determines whether or not the counter 4 has reached a count representing a time for measuring a current to flow through the charge roller 2 (step S23). If the answer of the step S23 is NO, the controller 30' simply waits. As soon as the counter 4 reaches such a count (YES, step S23), the controller 30' causes a charging operation for the second measurement to occur (step S24) in the same manner as in the step S22. Again, the controller 30' receives a current flowing through the charge roller 2 from the current detector 32.

Thereafter, the controller 30' determines whether or not the current detected by the second measurement is −1 μA lower than the current detected by the first measurement (step S25). If the answer of the step S25 is NO, meaning that the charge roller 2 is scarcely smeared, the controller 30' resets the counter 4 and starts it again (step S26) and then returns to the step S23. If the answer of the step S25 is YES, meaning that the charge roller 2 has been contaminated, the controller 30' stores the current (step S27) and then causes the cleaner moving mechanism 10 to move the cleaner 22 into contact with the charge roller 2 (step S28). In this condition, the cleaner 22 cleans the surface of the charge roller 2 only for a predetermined period of time, e.g., 60 seconds. Subsequently, the controller 30' resets the counter 4 and starts it again (step S26) and then repeats the step S23 and successive steps.

Generally, as the number of times of image formation increases, the current flowing through the charge roller 2 becomes unable to regain the initial value if the bias voltage remains the same, despite that the cleaner 22 cleans the charge roller 2. In light of this, the bias voltage to the charge roller 2 should preferably be changed in such a manner as to restore the current to the initial value. Then, the charge roller 2 can charge the drum 1 under a certain preselected condition without regard to the number of times of image formation.

In this embodiment, the charge detector 32 and controller 30', FIG. 5, play the role of means for detecting the degree of contamination of the charge roller 2.

Figure 8:
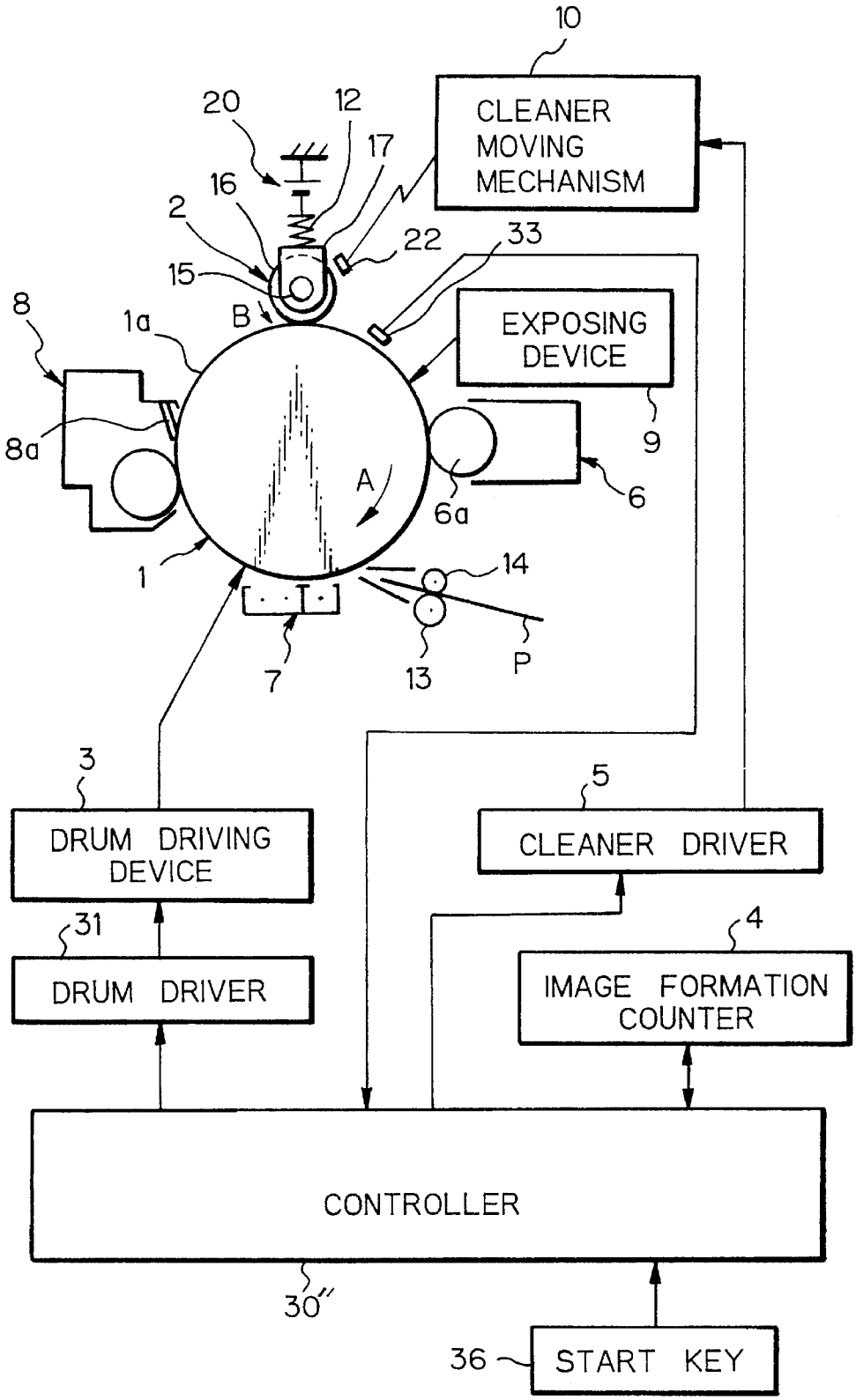
FIG. 8 is a view similar to FIG. 1, showing another alternative embodiment of the present invention.
Figure 9:
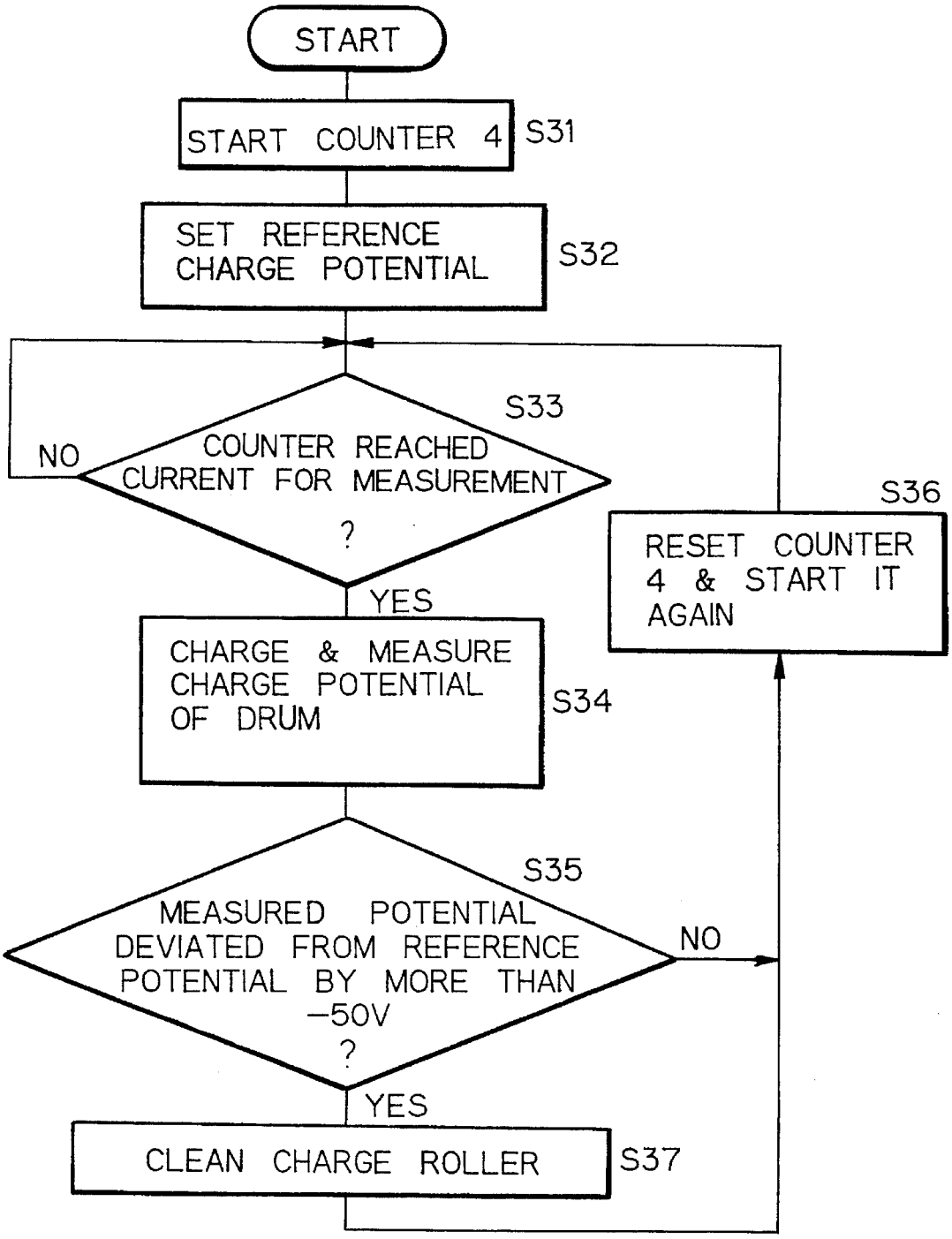
FIG. 9 is a flowchart demonstrating a specific operation of the embodiment shown in FIG. 8.

Referring to FIG. 8, another alternative embodiment of the present invention is shown. Briefly, this embodiment determines the degree of contamination of the charge roller 2 in terms of a change in the surface potential of the charged drum and changes, based on the degree of contamination, the predetermined time interval for causing the cleaner 22 to contact the charge roller 22. FIG. 9 is a flowchart demonstrating the operation of the embodiment. This embodiment is similar to the embodiment of FIG. 1 except for the following. The embodiment additionally includes an electrometer 33 for measuring a charge deposited on the drum surface 1*a* without contacting it. A controller 30" (also implemented by a microcomputer) determines the degree of contamination of the charge roller 2 in terms of the measured charge potential and causes the cleaner 22 to contact the charge roller 2 at an adequate time.

As shown in FIG. 9, the controller 30" starts the image formation counter 4 and increments it every time an image forming cycle completes (step S31 ). Then, the controller 30" causes a charging operation for the first measurement to occur. At this instant, the controller 30" receives a charge potential deposited on the drum surface 1*a* from the electrometer 33 and stores it as a reference value (S32). Alternatively, any suitable reference value or charge potential may be stored in a ROM beforehand. Subsequently, the controller 30" determines whether or not the counter 4 has reached a count representing a time for measuring a charge potential deposited on the drum surface 1*a* (step S33). If the answer of the step S33 is NO, the controller 30" simply waits. As soon as the counter 4 reaches such a count (YES, step S33), the controller 30" causes a charging operation for the second measurement to occur (step S34) in the same manner as in the step S32. Again, the controller 30" receives a charge potential measured by the electrometer 33.

The controller 30" determines whether or not the charge potential measured in the step S34 is deviated from the reference value set in the step S32 by more than −50 V (step S35). If the answer of the step S35 is NO, meaning that the charge roller 2 is scarcely smeared, the controller 30" resets the counter 4 and restarts it again (step S36) and then returns to the step S33. If the answer of the step S35 is YES, meaning that the charge roller 2 has been smeared, the controller 30" drives the cleaner moving mechanism 10 to cause the cleaner 22 to contact the charge roller 2 for a predetermined period of time, e.g., 60 seconds (step S37). In this condition, the cleaner 22 cleans the surface of the charge roller 2. Thereafter, the controller 30" resets the counter and starts it again (step S36) and then returns to the step S33.

As the number of times of image formation increases, the charge potential deposited on the drum surface 1*a* becomes unable to regain the initial value if the bias voltage remains the same, despite that the cleaner 22 cleans the charge roller 2. In light of this, the bias voltage to the charge roller 2 should preferably be changed in such a manner as to restore the charge potential to the initial value after cleaning. Then, the charge roller 2 can charge the drum surface 1*a* to a predetermined charge potential without regard to the number of times of image formation.

In the illustrative embodiment, the electrometer responsive to the surface potential of the drum 1 and the controller 30" play the role of means for detecting the degree of contamination of the charging member.

In the embodiments of FIGS. 6 and 7, the image formation counter 4 is reset and then started again every time a measurement occurs. Alternatively, the counter 4 may be continuously incremented, in which case the current will be detected every time the counter 4 reaches a count which is an integral multiple of the count representing the time for detecting a current. This is also true with the embodiment of FIG. 9 except for the substitution of the charge potential for the current. Further, in the step S14 of FIG. 6, the step 24 of FIG. 7 or the step 34 of FIG. 9, the measurement, i.e., the charging and erasing of the drum surface 1*a* may be repeated several times in order to determine the contamination of the charge roller 2 more accurately. In addition, in the step S13 of FIG. 6, the step S23 of FIG. 7 or the step S33 of FIG. 9, the count of the counter 4 representing the particular timing for measurement may be such that the measurement occurs relatively frequently, e.g., every time the copying cycle is repeated several tens or several hundreds of times. The allows an accidental smear occurred on the charge roller 2 to be detected and removed at an early stage.

As stated above, the embodiments shown in FIGS. 5–9 each determines the degree of contamination of the charge roller 2 in terms of a current flowing through the charge roller 2 or a charge potential deposited on the drum surface 1*a* and changes, based on the degree of contamination, the time interval for causing the cleaner 22 to contact the charge roller 2. Hence, even when the toner on the drum 1 is not removed due to paper dust or similar unexpected impurity and deposited on the charge roller 2 in a great amount, it can be removed immediately in order to obviate defective images.

While the foregoing description has concentrated on a charging member in the form of a roller and a photoconductive element in the form of a drum, the present invention is similarly practicable even when both the roller and the drum are replaced with belts.

In summary, it will be seen that the present invention provides an image forming apparatus having a cleaning member which contacts a charging member only for a predetermined period of time at predetermined intervals. This protects the surface of the charging member from scratches due to excessive cleaning and insures stable and uniform charging over a long term, thereby eliminating defective images.

An arrangement may be made such that after counting means for counting the number of times of image formation has reached a predetermined count, the cleaning member contacts the charge member only for a predetermined period of time every time the counting means reaches any suitable count. Then, the cleaning member is prevented from contacting the charging member at an initial stage, i.e., while no toner is deposited on the charging member. Hence, the charging member is free from scratches which would result in defective images. Alternatively, the apparatus may be so arranged as to change the time interval for causing the cleaning member to contact the charging member on the basis of the degree of contamination of the charging member. This is advantageous in that even when the toner on the photoconductive element is unable to be removed due to paper dust or similar unexpected impurity and deposited on the charging member in a great amount, the cleaning member contacts the charging member immediately and removes the toner. This also successfully eliminates defective images.

Various modifications will become possible for those skilled in the art after receiving the teachings of the present disclosure without departing from the scope thereof.

What is claimed is:

1. An image forming apparatus comprising:

a rotatable photoconductive element;

a charging member for charging said photoconductive element in contact with said photoconductive element while rotating;

a cleaning member for cleaning a surface of said charging member contacting said photoconductive element;

and cleaning member moving means for usually holding said cleaning member in a position spaced apart from said surface of said charging member and for causing said cleaning member to contact said surface of said charging member only for a predetermined period of time at a predetermined interval.

2. An apparatus as claimed in claim 1, further comprising:

counting means for counting a number of times of image formation occurred; and means for causing, after said counting means has reached a predetermined count, said cleaning member moving means to hold said cleaning member in contact with said surface of said charging member for said predetermined period of time every time said counting means reaches any suitable count.

3. An apparatus as claimed in claim 1, further comprising:

detecting means for detecting a degree of contamination of said surface of said charging member; and means for changing, based on the degree of contamination, said predetermined time interval for causing said cleaning member moving means to hold said cleaning member in contact with said surface of said charging member for said predetermined period of time.

* * * * *